US011198531B2

(12) United States Patent
Kitagaki et al.

(10) Patent No.: US 11,198,531 B2
(45) Date of Patent: Dec. 14, 2021

(54) RESIN MADE CONTAINER

(71) Applicant: SUNTORY HOLDINGS LIMITED, Osaka (JP)

(72) Inventors: Ayumu Kitagaki, Tokyo (JP); Shinya Ito, Tokyo (JP)

(73) Assignee: SUNTORY HOLDINGS LIMITED, Osaka (JP)

( * ) Notice: Subject to any disclaimer, the term of this patent is extended or adjusted under 35 U.S.C. 154(b) by 0 days.

(21) Appl. No.: 16/474,166

(22) PCT Filed: Nov. 22, 2017

(86) PCT No.: PCT/JP2017/042013

§ 371 (c)(1),
(2) Date: Jun. 27, 2019

(87) PCT Pub. No.: WO2018/123368

PCT Pub. Date: Jul. 5, 2018

(65) Prior Publication Data

US 2019/0315509 A1 Oct. 17, 2019

(30) Foreign Application Priority Data

Dec. 28, 2016 (JP) ..... JP2016-256160

(51) Int. Cl.
*B65D 1/02* (2006.01)

(52) U.S. Cl.
CPC ..... *B65D 1/0261* (2013.01); *B65D 1/0207* (2013.01)

(58) Field of Classification Search
CPC .. B65D 1/0261; B65D 1/0276; B65D 1/0207; B65D 1/023
See application file for complete search history.

(56) References Cited

U.S. PATENT DOCUMENTS 4,134,510 A 1/1979 Chang
4,465,199 A * 8/1984 Aoki ..... B29C 49/12 215/373

(Continued)

FOREIGN PATENT DOCUMENTS

EP 1471010 A1 10/2004
EP 2 653 400 10/2013

(Continued)

OTHER PUBLICATIONS

Official Communication issued in International Patent Application No. PCT/JP2017/042013, dated Dec. 26, 2017.

(Continued)

*Primary Examiner* — Andrew T Kirsch
(74) *Attorney, Agent, or Firm* — Greenblum & Bernstein, P.L.C.

(57) ABSTRACT

A resin made container includes a spout portion to/from which a cap can be attached/detached, a shoulder portion continuous with the spout portion, a body portion continuous with shoulder portion and a bottom portion continuous with body portion and disposed at a lowermost portion of the bottle. Bottom portion includes a bottom face which comes into contact with a disposing surface and a sloped portion extending with a slope from the bottom face to the body portion. At least a portion of a vertical cross sectional shape of the sloped portion is a linear portion or a curved portion which protrudes to the inner side of the container. An angle formed between the linear portion of sloped portion and disposing surface or an angle formed between a straight line interconnecting an upper end and a lower end of the curved portion and disposing surface ranges from 15 to 70 degrees.

6 Claims, 2 Drawing Sheets

(56) References Cited

U.S. PATENT DOCUMENTS

| | | | | |
|---|---|---|---|---|
| 4,759,454 | A | 7/1988 | Nowicki et al. | |
| 2004/0251258 | A1 | 12/2004 | Akiyama et al. | |
| 2005/0082250 | A1 | 4/2005 | Noriyuki et al. | |
| 2007/0205175 | A1* | 9/2007 | Darr ..... | B65D 1/023 215/40 |

FOREIGN PATENT DOCUMENTS

| | | | |
|---|---|---|---|
| JP | 55-163137 | | 12/1980 |
| JP | S56-48946 | A | 5/1981 |
| JP | 2001-180524 | | 7/2001 |
| JP | 2002-225834 | | 8/2002 |
| JP | 2005-104500 | | 4/2005 |
| JP | 2012-126449 | | 7/2012 |
| JP | 2012-250741 | | 12/2012 |
| JP | 2017-159956 | | 9/2017 |

OTHER PUBLICATIONS

Official Communication issued in International Patent Application No. PCT/JP2017/042013, dated Jul. 2, 2019.
Supplementary European Search Report in counterpart European Application No. 17 88 8354, dated Jul. 30, 2020.

* cited by examiner

RESIN MADE CONTAINER

TECHNICAL FIELD

This invention relates to a resin made container such as a PET bottle.

BACKGROUND ART

As conventional resin made containers, there is known, from e.g. Patent Document 1, a PET bottle having a circumferential groove for preventing buckling deformation of the container.

BACKGROUND ART DOCUMENT

Patent Document

Patent Document 1: Japanese Unexamined Patent Application Publication No. 2012-126449

SUMMARY OF THE INVENTION

Problem to be Solved by Invention

However, with the conventional PET bottle, with provision of the circumferential groove, its uneven appearance can impair the aesthetic feature. Thus, there remains room for improvement. Accordingly, an object of the invention is to provide a resin made container having improved buckling deformation resistance, without impairing its aesthetic feature.

Solution

For accomplishing the above-noted object, according to a first characterizing feature of a resin made container relating to the present invention, the resin made container includes a spout portion to/from which a cap can be attached/detached, a shoulder portion continuous with the spout portion, a body portion continuous with the shoulder portion and a bottom portion continuous with the body portion and disposed at a lowermost portion of the bottle;

wherein the bottom portion includes a bottom face which comes into contact with a disposing surface and a sloped portion extending with a slope from the bottom face to the body portion;

at least a portion of a vertical cross sectional shape of the sloped portion is a linear portion or a curved portion which protrudes to the inner side of the container; and an angle formed between the linear portion of the sloped portion and the disposing surface or an angle formed between a straight line interconnecting an upper end and a lower end of the curved portion and the disposing surface ranges from 15 to 70 degrees.

According to a further characterizing feature of the resin made bottle of the invention, the vertical cross sectional shape of the sloped portion is formed of a first arc which protrudes to the outer side of the container, the linear portion and a second arc which protrudes to the outer side of the container, the first arc, the linear portion and the second arc being formed continuous in this order from the upper side.

According to a still further characterizing feature of the resin made container of the invention, the sloped portion has a height ranging from 4 to 13 mm.

According to a still further characterizing feature of the resin made container of the invention, a content volume of the container ranges from 250 to 650 mL.

According to a still further characterizing feature of the resin made container of the invention, the body portion has a maximum outer diameter ranging from 60 to 75 mm.

According to a still further characterizing feature of the resin made container of the present invention, the container has a weight ranging from 10 to 25 g.

According to a still further characterizing feature of the resin made container of the invention, an entire outer circumferential face of the body portion is formed of a smooth face substantially free from unevenness.

Effect of the Invention

With the above-described inventive feature, namely, the bottom portion including a bottom face which comes into contact with a disposing surface and a sloped portion extending with a slope from the bottom face to the body portion, at least a portion of a vertical cross sectional shape of the sloped portion being a linear portion or a curved portion which protrudes to the inner side of the container and an angle formed between the linear portion of the sloped portion and the disposing surface or an angle formed between a straight line interconnecting an upper end and a lower end of the curved portion and the disposing surface ranging from 15 to 70 degrees, it is possible to cause the bottom portion to be deformed easily when a perpendicular load is applied to the resin made container. With this, there occurs rise in the internal pressure of the resin made container. As a result, it is possible to make buckling deformation of the resin made container to occur less likely. Therefore, there is no need to provide e.g. the circumferential groove conventionally provided and no impairment to the aesthetic feature of the container will occur, either.

Further, in case an entire outer circumferential face of the body portion is formed of a smooth face substantially free from unevenness, for instance, in case the body portion is formed as a smooth face free from any depressurization absorbing panel or circumferential groove, this will not interfere with rise of the internal pressure of the resin made container at the time of application of a perpendicular load to the container, so the advantageous effect of making occurrence of buckling deformation occur less likely can be achieved more easily.

MODES OF EMBODYING THE INVENTION

Embodiment

Figure 1:
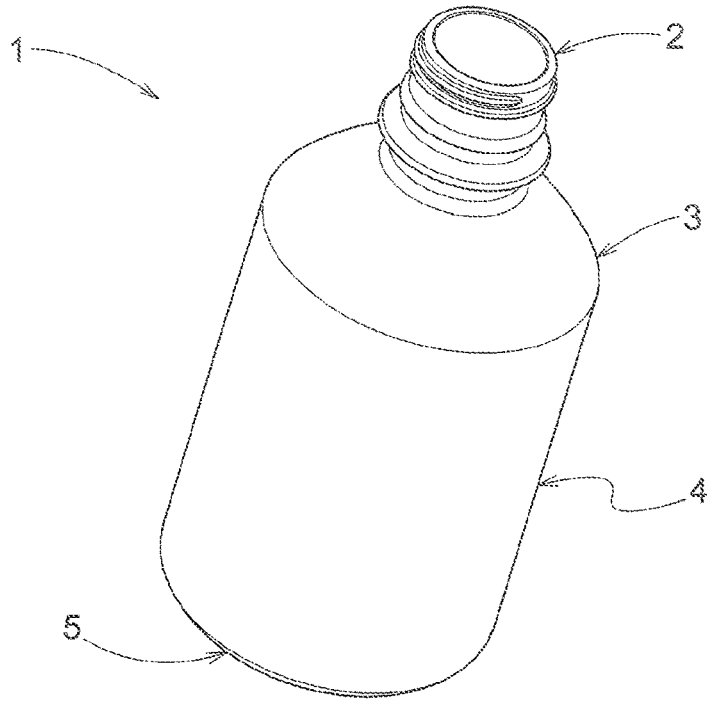
FIG. 1 is a perspective view of a resin made container.

Next, as a preferred embodiment of a resin made container relating to the present invention, there will be explained a plastic bottle 1 to be charged with liquid such as beverage, with reference to the accompanying drawings.

Firstly, various kinds of terms to be used in this detailed description will be defined as follows.

As used in this detailed description, a term "vertical direction" means a direction of a center axis X-X of a plastic bottle 1 shown in FIG. 1 (to be referred to simply as "bottle 1" hereinafter). In particular, in FIGS. 1-3, a term: upper side, refers to the upper end side in the drawings and a term: lower side refers to the lower end side of the drawings.

A term "lateral direction" or "horizontal direction" means the direction perpendicular to the center axis X-X direction.

A term "circumferential direction" means a direction along the contour of the horizontal cross sectional shape.

A term "radial direction" means the radial direction of a circle when the the center axis X-X is taken as the center of such circle.

A term "height" means a length along the center axis X-X direction.

A term "depth" means a length along the radial direction.

A term "horizontal cross sectional shape" means a cross sectional shape of the bottle 1 in a plane (horizontal cross section) perpendicular to the center axis X-X.

A term "vertical sectional shape" means a cross sectional shape of the bottle 1 in a plane (vertical cross section) along the center axis X-X.

Figure 2:
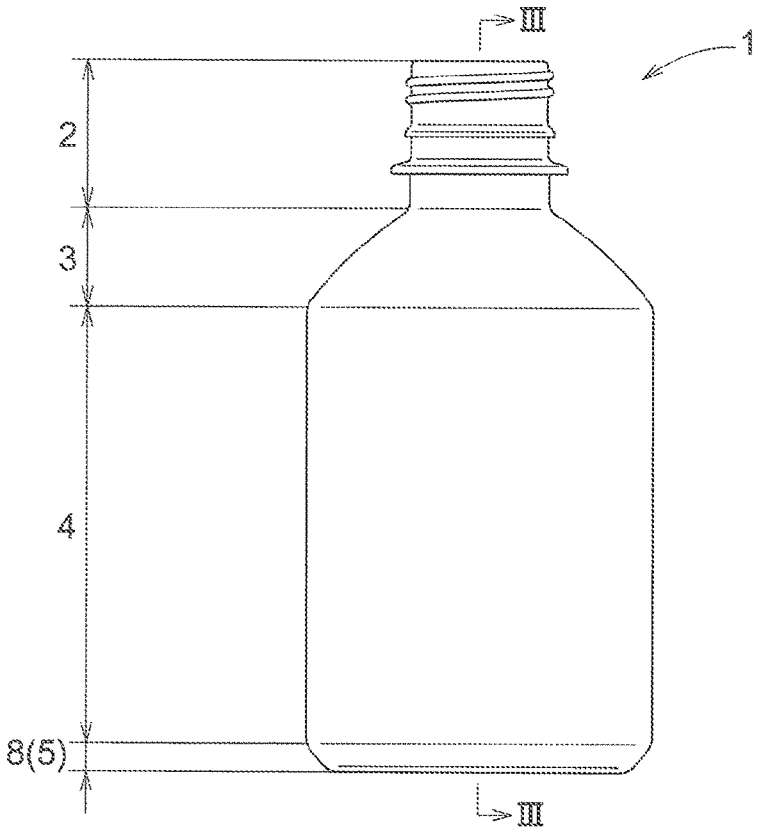
FIG. 2 is a side view of the resin made container.
Figure 3:
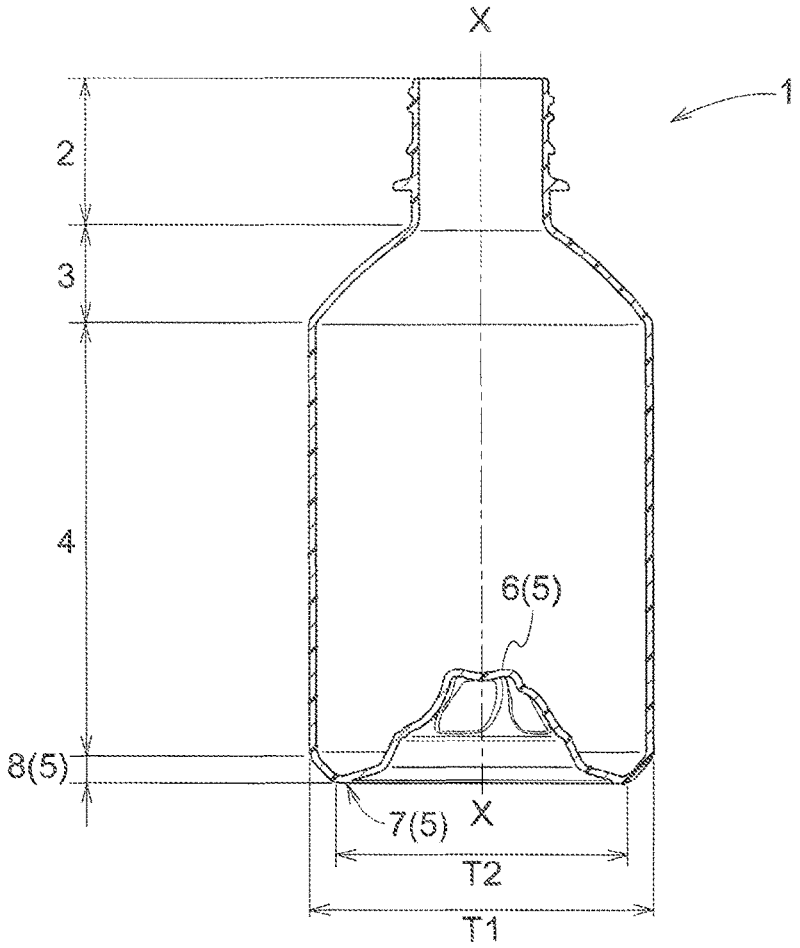
FIG. 3 is a vertical sectional view of the resin made container taken along a line in FIG. 2.

As shown in FIGS. 1 through 3, the bottle 1 relating to the instant embodiment includes, from the upper side thereof, a spout portion 2 to/from which a cap can be attached/detached, a shoulder portion 3 continuous with the spout portion 2, a body portion 4 continuous with the shoulder portion 3, and a bottom portion 5 continuous with the body portion 4 and located at the lowermost portion. Further, the bottle 1 relating to the instant embodiment is a cylindrical container having an approximately circular horizontal cross section.

The bottle 1 can be made of thermoplastic resin such as polyethylene, polypropylene, polyethylene terephthalate, etc. as its principal material, via a conventional molding method such as the biaxial stretching blow molding technique.

The content (liquid) to be charged in the bottle 1 is not particularly limited. As examples thereof, drinks such as drinking water, tea, juice, coffee, cocoa, soft drink, alcoholic drink, milk-based drink, soup, liquid seasoning such as sauce, soy sauce, etc. can be cited. Respecting beverage in particular, it is not limited to cold beverage, but it may be hot beverage such as coffee, tea, soup, etc. which are sold under heated state.

Further, the content volume of the bottle 1 is also not particularly limited, either. Depending on the kind of content to be charged therein, it can be appropriately set from a relatively small volume in the order of a few hundreds of milliliters, to a relatively large volume in the order to a few liters. Incidentally, when the bottle 1 is used as a beverage bottle, it is desired that its content volume ranges from 250 to 650 mL and its weight ranges from 10 to 25 g.

(Spout Portion)

The spout portion 2 is a part which is formed of a cylinder having an opened upper end and serves as an inlet for the beverage or the like. In the outer circumferential face of the spout portion 2, male threads are formed. So that, an unillustrated cap may be adapted to be detachably fixedly threaded thereto, thus allowing repeated sealing and opening.

(Shoulder Portion)

The shoulder portion 3 is a part which is provided with an approximately conical shape whose diameter progressively increases from its upper end to the lower side thereof. Advantageously, the vertical cross sectional shape of the shoulder portion 3 may be a gentle arc which is formed to protrude to the outer side of the container (e.g. a curvature radius=74 mm (74R)).

(Body Portion)

The body portion 4 is a cylindrical portion having an approximately circular cross sectional shape and has a largest outer diameter of the bottle 1. Further, in the outer circumferential face of the body portion 4, a label for indicating the brand of the beverage or the like can be provided. In the body portion 4 according to the instant embodiment, there are provided no depressurization absorbing portion which would be formed concave for preventing deformation of the container through a curved deformation thereof in correspondence with an internal pressure variation due to high-temperature charging or a volume change of the content liquid or no circumferential groove or the like for preventing buckling deformation of the container. Rather, the entire outer circumferential face of the body portion 4 is formed of a smooth face substantially free from any unevenness. However, depending on necessity, such depressurization absorbing portion, such circumferential groove, or the like may be provided in the body portion 4.

Incidentally, in case the content volume of the container 1 is set from 250 to 650 mL and its weight is set from 10 to 25 g, it is desired that the maximum outer diameter of the body portion 4 range from 60 to 75 mm.

(Bottom Portion)

As shown in FIG. 3, in the bottom portion 5, there are formed continuously a receded portion 6 which is receded in the form of a chevron to the inner side of the container, a bottom face 7 which will come into contact with a disposing surface P when the bottle 1 is placed vertically and a sloped portion 8 extending with a slope from the bottom face 7 to the body portion 4. The bottom face 7 presents a ring shape as seen in a plan view and is disposed in the outer circumference of the receded portion 6.

Figure 4:
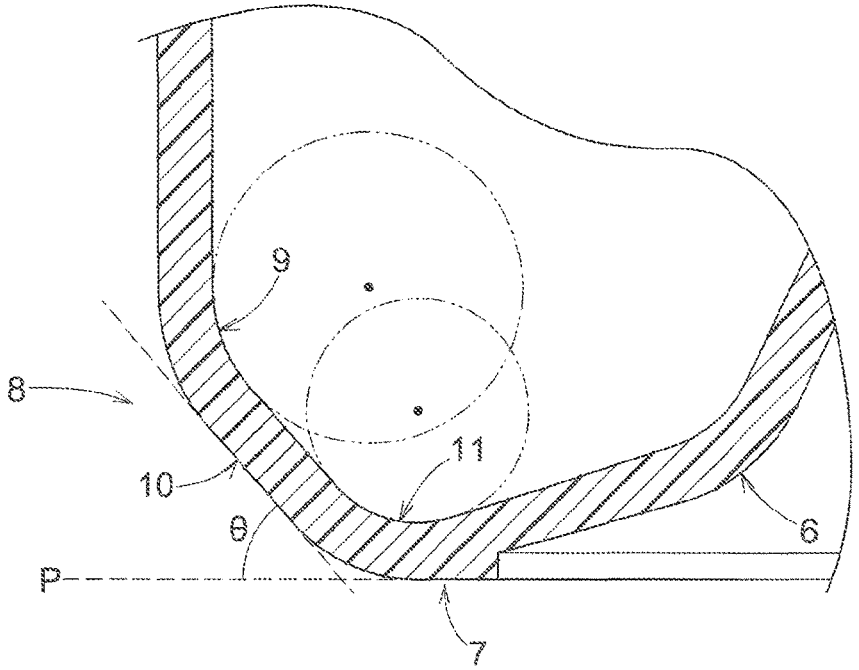
FIG. 4 is a vertical sectional view showing vicinity of a sloped portion.

As shown in FIG. 4, at least a portion of the vertical cross sectional shape of the sloped portion 8 is formed linear. Further, an angle θ formed between the linear portion 10 of the sloped portion 8 and the disposing surface P ranges from 15 to 70 degrees, preferably from 15 to 50 degrees, even more preferably from 15 to 40 degrees. If this angle θ is too large, this will make it difficult for the shape deformation of the bottom portion at the time of application of perpendicular load to the resin made container to occur. Conversely, if this angle θ is too small, this will make it difficult to obtain the effect of internal pressure rise inside the resin made container through shape deformation of the bottom portion. Further, the height of the sloped portion 8 ranges preferably from 4 to 13 mm, more preferably from 4 to 10 mm.

The vertical cross sectional shape of the sloped portion 8 in this embodiment is comprised of a first arc 9 which protrudes to the outer side of the container, the linear portion 10 and a second arc 11 which protrudes to the outer side of the container, with these portions being formed continuous in this order from the upper side. Further, advantageously, the curvature radius of the first arc 9 is greater than the curvature radius of the second arc 11. For instance, the curvature radius of the first arc 9 can be 5 mm (5R), and the curvature radius of the second arc 11 can be 4 mm (4R). Also, advantageously, the length of the linear portion 10 can be greater than or equal to 1 mm.

Advantageously, the diameter decrease ratio of the maximum outer diameter T2 of the bottom face 7 relative to the maximum outer diameter T1 of the body portion 4 can range from 70% to 90%.

Further Embodiment

Lastly, though not shown, a further embodiment of the resin made container relating to the present invention will be explained. In the foregoing embodiment, it was shown that at least a portion of the vertical cross sectional shape of the sloped portion 8 is formed linear. However, in the course of a bottle sterilization process, a rinsing process or a charging process of the bottle 1, this portion formed linear can be curved to protrude to the inner side of the container. In such case, at least a portion of the vertical cross sectional shape of the sloped portion 8 will be formed as a curved portion protruding to the inner side of the container. And, an angle formed between a straight line interconnecting the upper end and the lower end of such curved portion and the disposing surface P will range from 15 to 70 degrees, preferably from 15 to 50 degrees, even more preferably from 15 to 40 degrees. In the case of this alternative arrangement too, the advantageous effect of the present invention can be achieved and such further embodiment too will be included in the claimed scope of the present invention.

INDUSTRIAL APPLICABILITY

The resin made container of the present invention can be used as a container in which beverage, seasoning, etc. is charged in a sealed state.

DESCRIPTION OF SIGNS

1 bottle
2: spout portion
3: shoulder portion
4: body portion
5 bottom portion
6: receded portion
7; bottom face
8: sloped portion
9; first arc
10: linear portion
11: second arc
P: disposing surface
θ: angle between linear portion of sloped portion and disposing surface
T1: maximum outer diameter of body portion
T2: maximum outer diameter of bottom face

The invention claimed is:

1. A resin made container including a spout portion to/from which a cap can be attached/detached, a shoulder portion continuous with the spout portion, a body portion continuous with the shoulder portion and a bottom portion continuous with the body portion and disposed at a lowermost portion of the bottle;

wherein the bottom portion includes a bottom face which comes into contact with a disposing surface and a sloped portion extending with a slope from the bottom face to the body portion;

at least a portion of a vertical cross sectional shape of the sloped portion is a linear portion or a curved portion which protrudes to the inner side of the container;

an angle formed between the linear portion of the sloped portion and the disposing surface or an angle formed between a straight line interconnecting an upper end and a lower end of the curved portion and the disposing surface ranges from 15 to 40 degrees;

wherein the vertical cross sectional shape of the sloped portion is formed of a first arc which protrudes to the outer side of the container, the linear portion and a second arc which protrudes to the outer side of the container, the first arc, the linear portion and the second arc being formed continuous in this order from an upper side of the bottom portion; and the first arc has a curvature radius greater than a curvature radius of the second arc.

2. The resin made container of claim 1, wherein the sloped portion has a height ranging from 4 to 13 mm.

3. The resin made container of claim 1, wherein a content volume of the container ranges from 250 to 650 mL.

4. The resin made container of claim 3, wherein the body portion has a maximum outer diameter ranging from 60 to 75 mm.

5. The resin made container of claim 3, wherein the container has a weight ranging from 10 to 25 g.

6. The resin made container of claim 1, wherein an entire outer circumferential face of the body portion is formed of a smooth face substantially free from unevenness.

* * * * *